US008292138B2

(12) United States Patent
Lucey

(10) Patent No.: US 8,292,138 B2
(45) Date of Patent: Oct. 23, 2012

(54) MULTI-FUNCTION BACKPACK FOR MUSICAL INSTRUMENT CASES

(76) Inventor: John King Lucey, Bend, OR (US)

( * ) Notice: Subject to any disclaimer, the term of this patent is extended or adjusted under 35 U.S.C. 154(b) by 0 days.

(21) Appl. No.: 12/748,935

(22) Filed: Mar. 29, 2010

(65) Prior Publication Data

US 2011/0233083 A1 Sep. 29, 2011

(51) Int. Cl.
*A45F 3/04* (2006.01)

(52) U.S. Cl. ..... 224/259; 224/153; 224/627; 206/314

(58) Field of Classification Search ..... 206/14, 206/314, 315; 190/112, 107; 150/154, 162; 224/579, 153, 259, 613, 627, 250
See application file for complete search history.

(56) References Cited

U.S. PATENT DOCUMENTS 4,249,687 A * 2/1981 Warnier ..... 224/613
4,972,981 A * 11/1990 Gex ..... 224/645
5,579,966 A * 12/1996 Krumweide et al. ..... 224/637
5,669,495 A * 9/1997 West ..... 206/317
5,918,785 A * 7/1999 Irose ..... 224/259
6,024,265 A * 2/2000 Clements ..... 224/630
6,347,730 B1 * 2/2002 Frederick ..... 224/259
6,505,762 B2 * 1/2003 Wilfer ..... 224/153
D487,627 S * 3/2004 Izen et al. ..... D3/204
6,889,882 B1 * 5/2005 Leep ..... 224/579
7,717,310 B2 * 5/2010 Zalinsky et al. ..... 224/644
2003/0006258 A1 * 1/2003 Flynn ..... 224/259
2008/0047637 A1 * 2/2008 Mosier ..... 150/154
2009/0152143 A1 * 6/2009 Leach ..... 206/314
2009/0242601 A1 * 10/2009 Inman ..... 224/602

* cited by examiner

*Primary Examiner* — David Fidei

(57) ABSTRACT

A multi-function backpack for musical instrument cases. The multi-function backpack for musical instrument cases is constructed with fabric panels, transverse straps, and is secured by releasable buckles and hook and loop fabric to ensure the instrument case is secure even if a releasable buckle is broken. The multi-function backpack for carrying musical instrument cases is designed to fit a variety of instrument cases and to serve as a platform for the addition of pockets, gear loops, and other accessories.

2 Claims, 6 Drawing Sheets

MULTI-FUNCTION BACKPACK FOR MUSICAL INSTRUMENT CASES

DESCRIPTION OF PRIOR ART

Prior methods of carrying instruments on the back have included everything from a piece of rope to the soft shell "gig bag" to hard cases with riveted buckles attached to them (US203/0006258 A1) to a bag for musical instruments (U.S. Pat. No. 6,505,762) to the webbing strap carrying assembly (U.S. Pat. No. 5,918,785 A). The soft shell "gig bag" cannot protect the instrument from damage as well as a hard case can, thus the best way to protect the instrument is to leave it in its hard case and carry the hard case. Carrying instruments by the handle of the hard case for any amount of time can cause fatigue in the hand. By carrying the hard case on the back, the porter experiences less fatigue.

Not all hard cases are produced with rivets for straps like (US203/0006258 A1). The multi-function backpack for musical instrument cases is designed to fit instrument cases whether they are riveted or not.

The bag for musical instruments (U.S. Pat. No. 6,505,762) relies upon a zipper to secure the instrument case which creates an inherent point of weakness in the design because the weight of the instrument is being supported by only the strength of the zipper. The multi-function backpack for musical instrument cases avoids this inherent weakness of the zipper used to secure the bag for musical instruments (U.S. Pat. No. 6,505,762) by using sewn panels to cradle the bottom of the instrument case. Also, because the bag for musical instruments (U.S. Pat. No. 6,505,762) claims to have the shape of the musical instrument case, it does not lend itself to fit a variety of musical instrument cases, but must be custom tailored to each particular case for a proper fit.

Instrument cases are designed and built to closely match the shape of the instrument they contain to best protect the instrument. These instrument cases conform to the length of the neck of the instrument and to the contours of the body of the instrument. The multi-function backpack for musical instrument cases does not claim to have the shape of the musical instrument case as claimed by the bag for musical instruments (U.S. Pat. No. 6,505,762). Instead, the multi-function backpack for musical instrument cases is designed to allow for the multitude of various contours of the body of the instrument case by securing the instrument case with the bottom panels and two transverse straps that attach above the contours of the body of the case where the case's shape corresponds to the spot where the neck of the instrument meets the body of the instrument.

The multi-function backpack for musical instrument cases differs from the webbing strap assembly (U.S. Pat. No. 5,918,785 A) in basic design, capabilities, and fastening method. While the body of the webbing strap assembly (U.S. Pat. No. 5,918,785 A) is composed entirely of webbing, the multi-function backpack for musical instrument cases relies upon fabric panels which provide a platform for the unlimited addition and configuration of pockets and accessories Unlike the webbing strap carrying assembly (U.S. Pat. No. 5,918,785 A), the multi-function backpack for musical instrument cases' buckling system provides a hook and loop fastener back-up system to protect the instrument case from becoming detached from the backpack if a releasable buckle is broken or not properly fastened.

Instrument hard cases open on hinges. Because instrument hard cases open on hinges, the placement of the buckles on the hinge and handle sides of the multi-function backpack for musical instrument cases allows for the instrument case to be opened without completely removing the case from the backpack by releasing only those buckles opposite the hinges of the case. This is not possible with the webbing strap carrying assembly (U.S. Pat. No. 5,918,785 A) whose buckle position is on the side toward the wearer per claim 4 of patent (U.S. Pat. No. 5,918,785 A).

Per FIG. 1 of patent (U.S. Pat. No. 5,918,785 A), the webbing strap carrying assembly (U.S. Pat. No. 5,918,785 A) has one upper transverse strap above the point where the neck meets the body of the instrument and one lower transverse strap that cradles the body of the case. This lower transverse strap also serves as the lower attachment point for the shoulder straps per claim 1 of patent (U.S. Pat. No. 5,918,785 A). The multi-function backpack for musical instrument cases has both transverse straps above the point where the neck meets the body of the instrument and the shoulder straps attach to points on the back panel and not to the transverse straps. By placing both transverse straps above the point where the neck meets the body of the instrument, the dimensions and contours of the body are moot and no complicated adjustments are required to secure the case.

SUMMARY OF THE PRESENT INVENTION

The present invention discloses a multi-function backpack for musical instrument cases consisting of sewn fabric panels, straps with releasable buckles and hook and loop fasteners, pockets, and shoulder straps. The fabric panels provide a platform for unlimited addition and configuration of pockets and accessories.

The present invention discloses a multi-function backpack for musical instrument cases comprising: a front panel with pockets and an attached transverse strap containing hook and loop fasteners and releasable buckles; a back panel with an attached lower and upper transverse strap with attached hook and loop fasteners and releasable buckles, two bottom panels, and two shoulder straps.

DETAILED DESCRIPTION OF THE PREFERRED EMBODIMENTS

Figure 1:
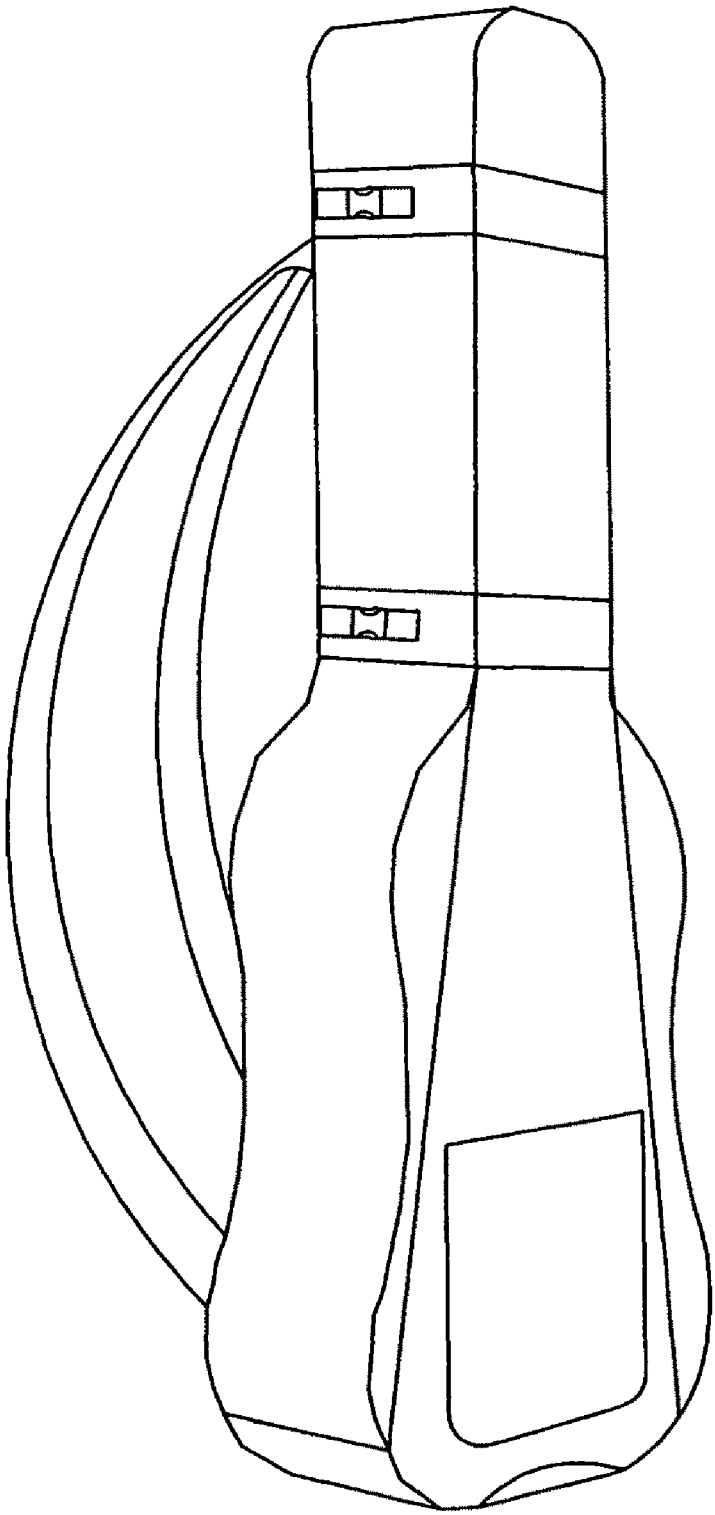
FIG. 1 is a view of the multi-function backpack for musical instrument cases as shown on a guitar case

Referring now to FIG. 1, the multi-function backpack for musical instrument cases is shown installed on a guitar case. The guitar case is just an example of the musical instrument cases that can be carried in the multi-function backpack for musical instrument cases. The multi-function backpack for musical instrument cases is not limited to guitar cases and is suitable for a carrying wide range musical instrument cases.

Figure 2:
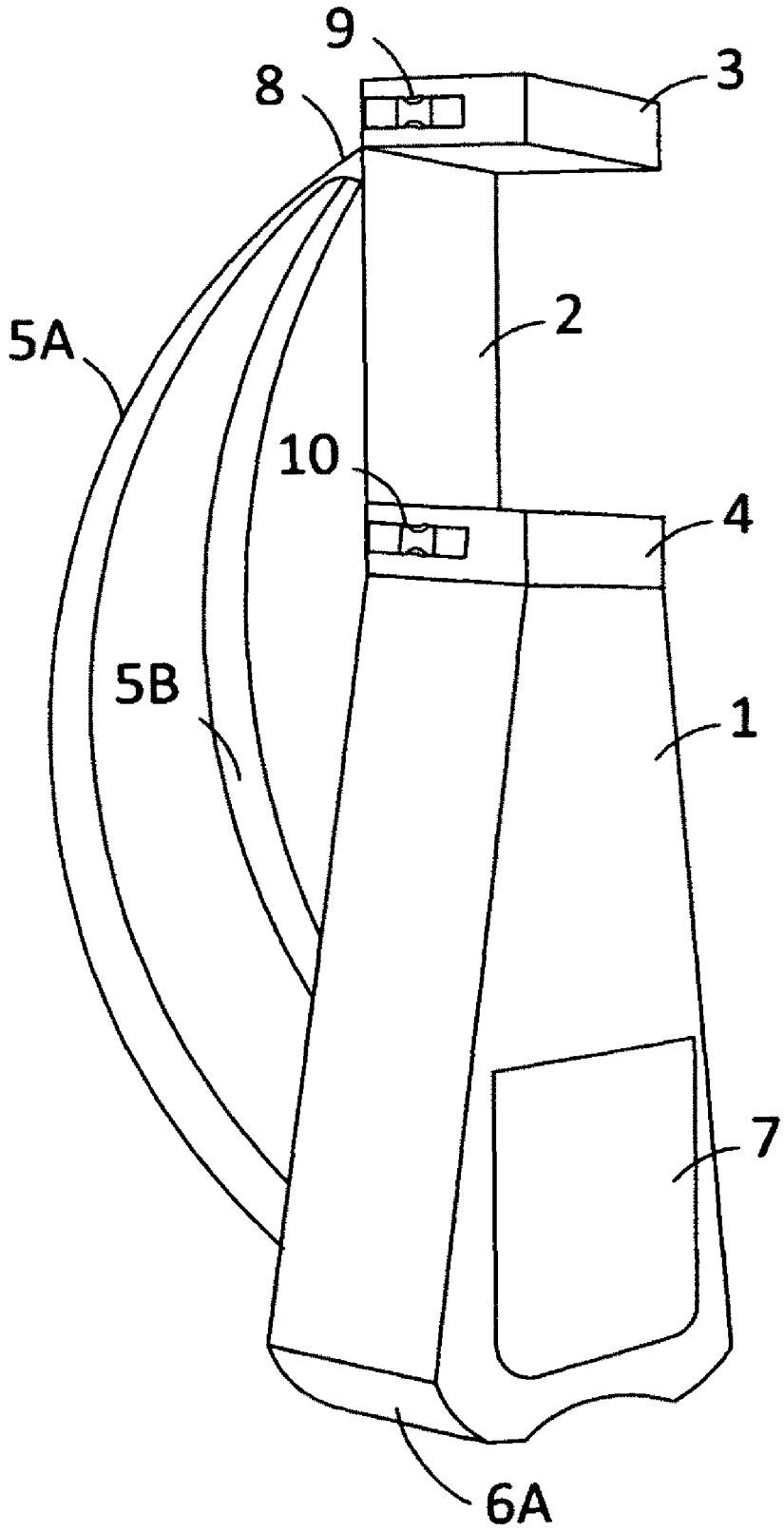
FIG. 2 is a perspective view of the front and right sides of the multi-function backpack for musical instrument cases

Referring now to FIG. 2, the multi-function backpack for musical instrument cases is shown. The components of the multi-function backpack for musical instrument cases shown in FIG. 2 include the front fabric panel (1), the back fabric panel (2), the upper transverse strap (3) attached to the back fabric panel (2), the front transverse strap (4) attached to the front panel (1), a pocket (7) attached to the front panel (1), a bottom panel (6A) attached to and connecting the front panel (1) and the back panel (2), shoulder straps (5A) and (5B) attached to the back panel (2) at point (8), the releasable buckle (9) attached to the upper transverse strap (3) and the releasable buckle (10) attached to the front transverse strap (4) and the lower transverse strap (reference (12) FIG. 6) attached to the back panel (2).

Figure 3:
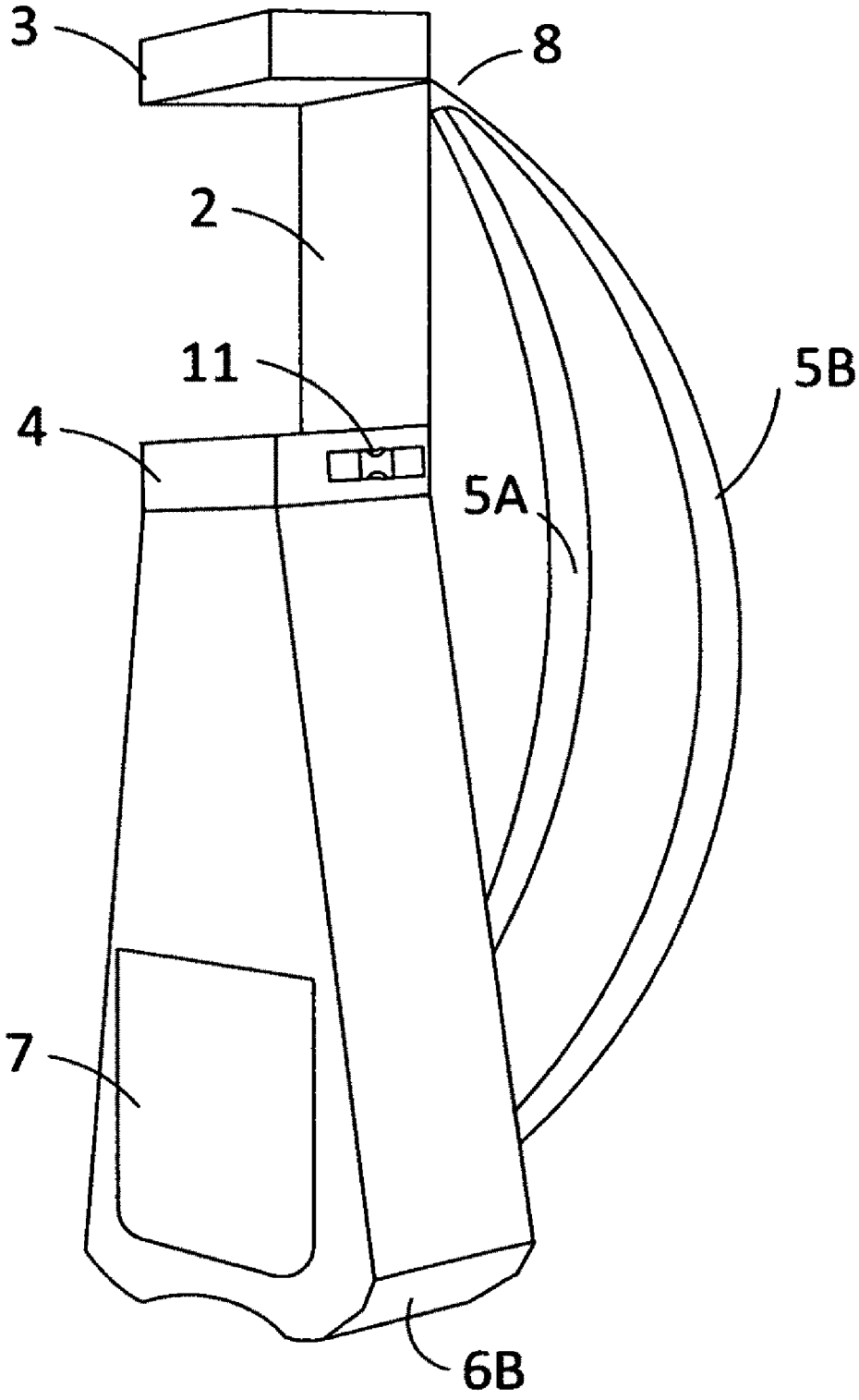
FIG. 3 is a perspective view of the front and left sides of the multi-function backpack for musical instrument cases

Referring now to FIG. 3, the multi-function backpack for musical instrument cases is shown. The components of the multi-function backpack for musical instrument cases shown in FIG. 3 include the releasable buckle (11) attached to the front transverse strap attached to the front panel (1) and the lower transverse strap (reference (12) FIG. 6) attached to the back panel (2). Also shown is the other bottom panel (6B) attached to and connecting the front panel (1) and the back panel (2).

Figure 4:
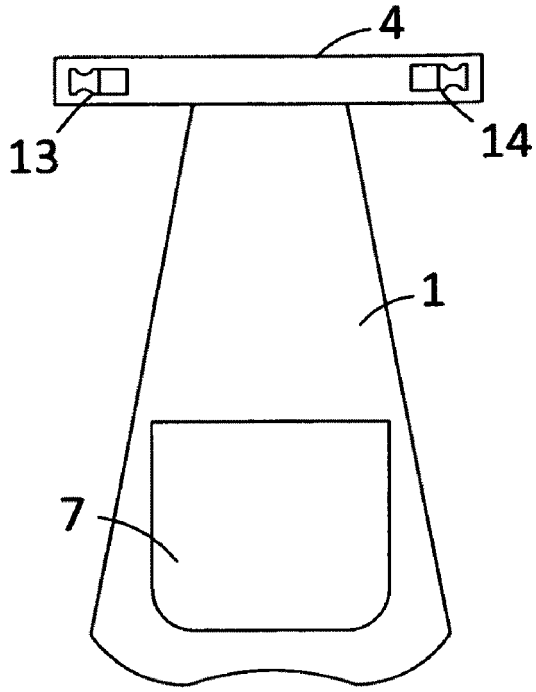
FIG. 4 is a view of the front of the multi-function backpack for musical instrument cases and the associated components

Referring now to FIG. 4, the front of the multi-function backpack for musical instrument cases is shown. The components shown include the front panel (1) the front strap (4) attached to the front panel (1) the pocket (7) attached to the front panel (1) and the "female" end of the releasable buckles (13 & 14) attached to the front strap (4).

Figure 5:
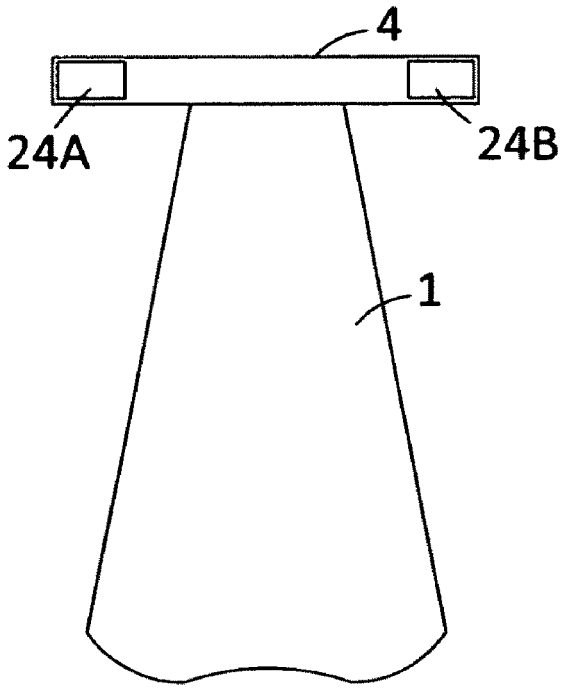
FIG. 5 is a view of the reverse side of the front of the multi-function backpack for musical instrument cases and the associated components

Referring now to FIG. 5, the reverse side of the front of the multi-function backpack for musical instrument cases is shown. The components shown include the front panel (1) the front strap (4) attached to the front panel (1) the hook component of the hook and loop fabric (24A & 24B) attached to the front strap (4).

Figure 6:
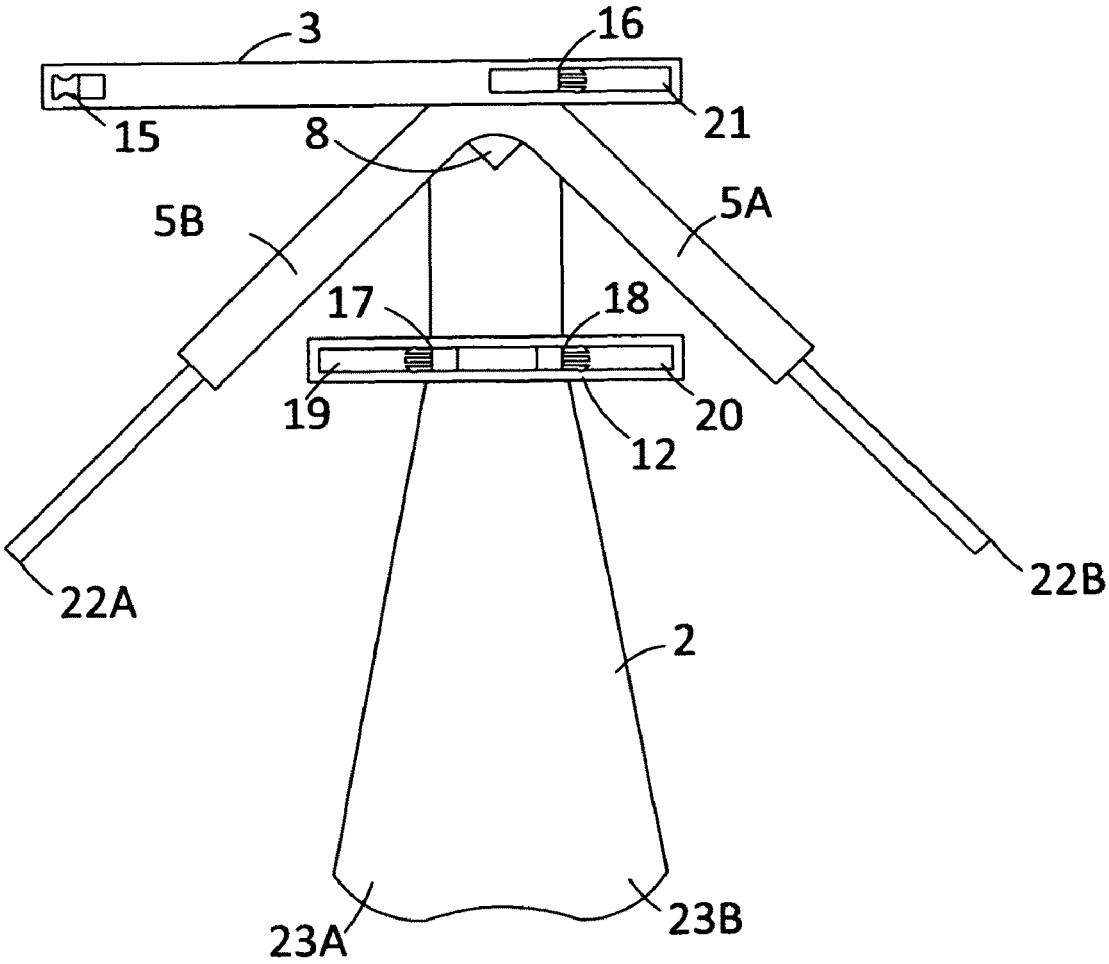
FIG. 6 is a view of the back of the multi-function backpack for musical instrument cases and the associated components.

Referring now to FIG. 6, the back of the multi-function backpack for musical instrument cases is shown. The components of the multi-function backpack for musical instrument cases shown include the back panel (2), the upper transverse strap (3) attached to the back panel (2), the lower transverse strap (12) attached to the back panel (2), the "male" end of the releasable buckles (17 & 18) attached to the lower transverse strap (12) which connect to the "female" ends of the releasable buckles (see 13 & 14 FIG. 4), the loop component of the hook and loop fabric (19 & 20) attached to the lower strap (12) which connect to the hook component of the hook and loop fabric sewn to the front transverse strap (4) (see 24A & 24B FIG. 5), the shoulder straps (5A & 5B) attached to the top of the back panel (2) at point (8) and to the bottom of the back panel (2) by attaching the end of the straps (22A & 22B) to points (23A & 23B), the "female" end of the releasable buckle (15) attached to the upper transverse strap (3) and the "male" end of the buckle (16) attached to the upper transverse strap (3), and the loop component (21) of the hook and loop fabric attached to the upper transverse strap (3).

Figure 7:
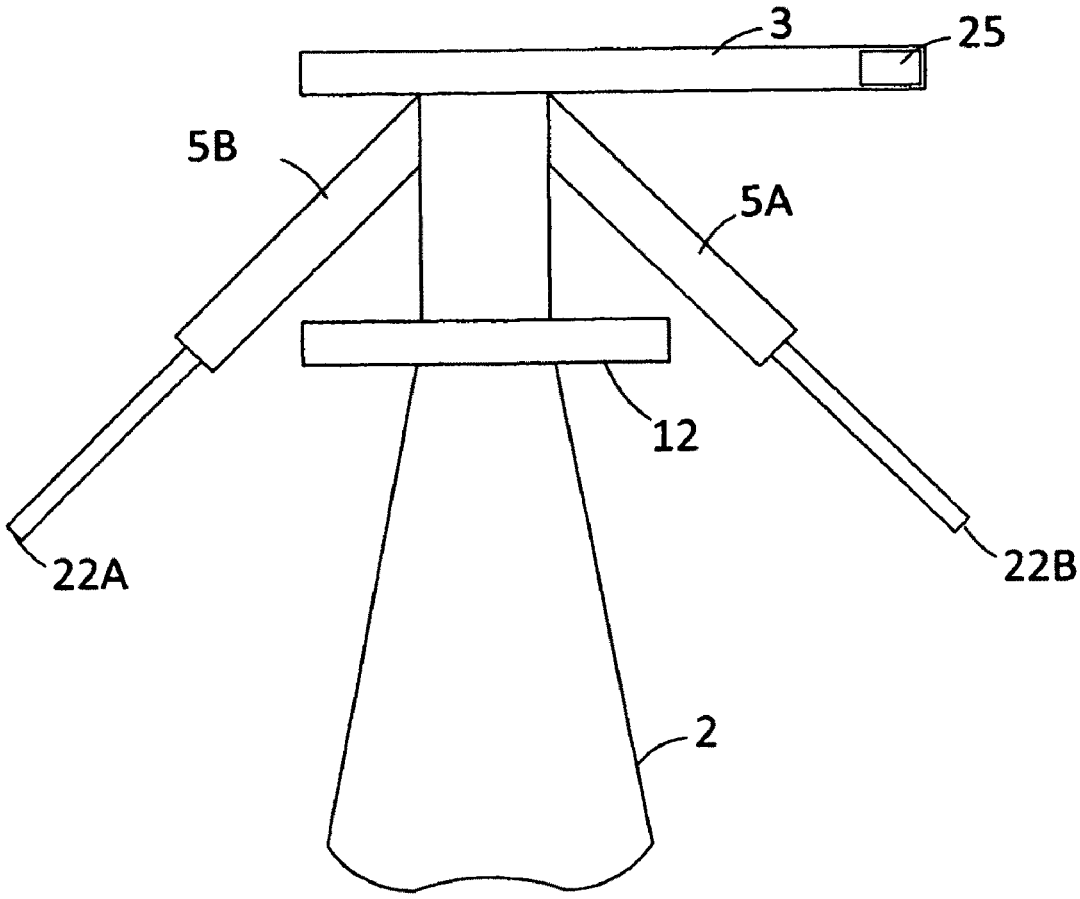
FIG. 7 is a view of the reverse side of the back of the multi-function backpack for musical instrument cases and the associated components

Referring now to FIG. 7, the reverse side of the back of the multi-function backpack for musical instrument cases is shown. The components shown include the back panel (2) the upper transverse strap (3) attached to the back panel (2) and the hook component of hook and loop fabric (25) attached to the upper strap (3).

Figure 8:
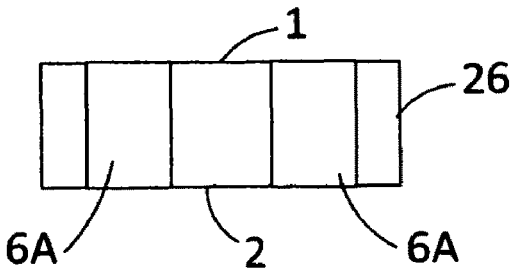
FIG. 8 is a view of the bottom panels of the multi-function backpack for musical instrument cases as shown on a musical instrument case

Referring now to FIG. 8, the bottom of the multi-function backpack for musical instrument cases is shown installed on a musical instrument case (26). The components shown include the bottom panels (6A & 6B) attached to the front panel (1) and the back panel (2) installed on an instrument hard case (26).

OPERATION OF THE INVENTION

The following is the method of operation of the multi-function backpack for musical instrument cases. First, the multi-function backpack for musical instrument cases is laid on its back. Then, the instrument case is placed in the multi-function backpack for musical instrument cases and the buckles (9, 10, 11) and the hook and loop fabric (19, 20, 21, 24A, 24B, 25) are buckled to secure the instrument in the multi-function backpack for musical instrument cases. Then, the user carries the multi-function backpack for musical instrument cases containing the musical instrument case by its shoulder straps (5A & 5B). Objects can be carried in the pocket (7) on the front panel (1).

I claim:

1. A multi-function backpack for musical instrument cases comprising:

front and back fabric panels;

at least one pocket sewn to front panel;

two bottom fabric panels attached to and connecting the front and back panels;

a transverse strap attached to front panel;

a lower transverse strap attached to the back panel;

an upper transverse strap attached to the back panel;

a buckling system consisting of a combination of releasable buckles and hook and loop fabric attached to upper and lower straps; and shoulder straps sewn to back panel.

2. The multi-function backpack for musical instrument cases of claim 1, wherein buckles are provided on the upper and lower transverse straps on sides that correspond to a wearer's right and left sides.

* * * * *